United States Patent [19]

Casutt

[11] 4,122,988

[45] Oct. 31, 1978

[54] PIERCE RIVET MACHINE

[75] Inventor: Max Casutt, San Diego, Calif.

[73] Assignee: Rohr Industries, Inc., Chula Vista, Calif.

[21] Appl. No.: 842,738

[22] Filed: Oct. 17, 1977

[51] Int. Cl.[2] ..... B21J 15/10

[52] U.S. Cl. ..... 227/53; 29/34 B; 29/243.54

[58] Field of Search ..... 29/34 B, 243.53, 243.54, 29/432.1, 509, 512; 227/53

[56] References Cited

U.S. PATENT DOCUMENTS

| | | | |
|---|---|---|---|
| 2,227,402 | 12/1940 | Ward | 227/61 |
| 3,559,269 | 2/1971 | Schmitt et al. | 29/243.54 |

*Primary Examiner*—Roy Lake
*Assistant Examiner*—Paul A. Bell
*Attorney, Agent, or Firm*—Patrick J. Schlesinger; Frank D. Gilliam

[57] ABSTRACT

A pierce rivet machine for simultaneously pierce riveting sheets of material to the opposing flanges of a channel shaped member having a first and a second pierce rivet driver, a first and a second pierce rivet holder for respectively holding rivets for said first and second pierce rivet drivers, and a first and a second anvil each respectively positioned to function in conjunction with the operation of said first and second pierce rivet drivers. The first and second pierce rivet drivers are positioned diametrically opposed to each other. A drive rod supports each pierce rivet driver and attached to the end of the drive rod is a link member and bellcrank for driving the drive rod along an axial reciprocating path. A tie bar has its ends pivotally attached to the bellcranks causing the drive rods to be simultaneously actuated. One of the bellcranks has its end pivotally attached to an air cylinder motor that operates the machine. The first and second anvils are supported by a first and a second anvil arm each of which has one end pivotally connected to an anvil block assembly. The anvil block assembly has a back-up plate that is driven into and out of position between the first and the second anvil support arms during the pierce riveting operation. The structure for driving the back-up plate back and forth comprises a back-up plate guide, an elongated curved slot in the tie bar, and a pin mounted in the top of the back-up plate guide that is captured in the elongated curved slot. The pierce rivet holders are each supported by an actuator rod that travels along an axial reciprocating path during the pierce rivet operation. Each rivet holder also has a guide with a link member attached between the actuator and the guide to prevent the rivet holder from turning during the pierce rivet operation. The pierce rivet machine also has structure for automatically feeding rivets into the first and second rivet holders.

13 Claims, 4 Drawing Figures

49
72
46
48
50
44
70
53
52
126
116
120
55
20
28
42
95
26
106
109
97
24
14
62
38
92
60
91
36
94
86
84
40
18
90
98
30
110
32
104

95
97
109
24
14
62
38
60
42
94
36
84
86
40
18
90
98
30
110
104
32
34
70
86
118
80
76
82
74
78
20

PIERCE RIVET MACHINE

BACKGROUND OF THE INVENTION

The invention relates in general to riveting machines and more particularly to a pierce riveting machine capable of simultaneously pierce riveting sheets of material to the opposing flanges of channel shaped member.

Riveting machines of various types have been known for years. Most of the riveting machines are of the standard type wherein the material to be joined together has holes drilled into it and the rivet blank is inserted therethrough prior to heading up or flattening of the rivet's ends. The pierce rivet machine operates to drive the rivet through the material without drilling a hole in it first. After the rivet has pierced the material, it is headed up on an anvil positioned beneath the material.

Previous riveting machines have been developed that allow two rivets to be simultaneously headed up in work having a curved surface where the rivets have been inserted one after another in a line such as is described in U.S. Pat. No. 2,227,402. The rams that accomplish the riveting operation of this machine are both mounted above the work piece being operated upon.

Another type of riveting machine which has simultaneous ram impact is that described in U.S. Pat. No. 3,559,269. This riveting machine utilizes separate rams impacting the opposite ends of a rivet simultaneously. The machine does not provide for simultaneously riveting two rivets at the same time.

Clearly a machine capable of simultaneously riveting several rivets from the same side of the work piece is not new. However, of all the prior art multiple riveting machines, none are capable of simultaneously riveting operations on the opposite flanges of a channel shaped member. Using prior art riveting machines to accomplish the purpose for which applicant's machine has been designed results in being able to only rivet on one flange of the channel shaped member at a time, which results in more than twice the work time required for the operation of applicant's machine.

It is an object of the invention to provide a novel pierce riveting machine capable of simultaneously pierce riveting sheets of material to the opposing flanges of a channel shaped member.

It is also an object of the invention to provide a pierce rivet machine that is economical to manufacture.

It is a further object of the invention to provide a novel pierce rivet machine that can simultaneously pierce rivet the opposing flanges of channel shaped members of various widths.

It is an additional object of the invention to provide a novel pierce rivet machine that can automatically feed the rivets to rivet holders both above and below the work piece.

SUMMARY OF THE INVENTION

The operation of the novel pierce rivet machine begins after the sheets of material to be riveted to the opposing flanges of a channel shaped member are clamped in their attaching positions. The pierce rivet machine may either be moved laterally along the material to be pierce riveted or the material to be pierce riveted may be passed through the pierce rivet machine while it is held stationary. The operation of the machine commences with the automatic delivering of the pierce rivets to the pierce rivet holders. Next the pierce rivet drivers are driven against the rivets causing them to pierce the sheet material and the flanges of the channel shaped member until they contact the anvils positioned within the channel shaped member. The pierce rivets are thus up headed on both their opposite ends to securely fasten the sheet material to the flanges.

The pierce rivet drivers are held by drive rods that reciprocate axially within a guide member. The free end of each drive rod is pivotally attached to one end of a link member whose opposite end is pivotally attached to a bellcrank. Pivotal movement of the bellcranks causes the drive rods to be axially reciprocated back and forth. Connected between the two bellcranks of the machine is a tie bar whose opposite ends are pivotally attached to the bellcranks. It is this tie bar that causes the drive rods to be actuated simultaneously. Pivotally attached to one end of one of the bellcranks is a piston rod emanating from an air cylinder motor. This single motor functions to operate both of the drive rods.

The anvils are supported within anvil arms having their one end pivotally attached to the anvil block assembly. The anvil block assembly has a back-up plate that is driven into and out of position between the anvil support arms during the pierce riveting operation. When the back-up plate has been withdrawn from between the anvil support arms, the anvil support arms pivot toward each other in a collapsed state allowing the work material to be freely transferred forwardly through the machine until the position is reached where the next rivet is to be applied. The back-up plate guide has a pin extending transversely to its length that is captured within in curved slot in the tie bar. The curved slot acts as a cam with the pin the cam follower. Therefore as the tie rod is caused to move forward and back the back-up plate guide is given transverse movement as the pin travels along the curved slot in the tie bar.

DESCRIPTION OF THE PREFERRED EMBODIMENT

Figure 1:
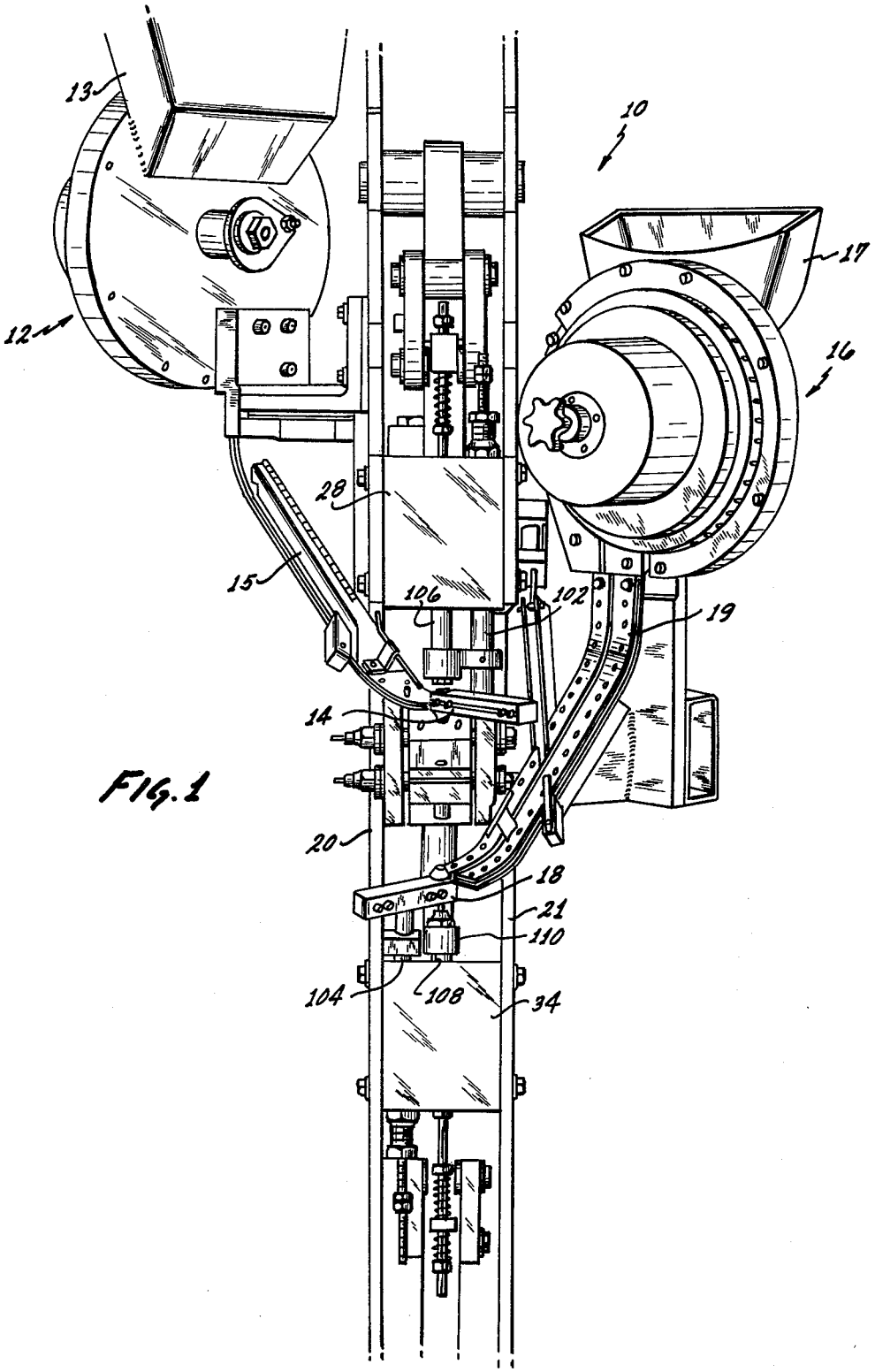
FIG. 1 is a front perspective view of the pierce rivet machine.

The pierce rivet machine will be described by referring to the drawings. In FIG. 1 the pierce rivet machine is generally designated numeral 10. It has a pair of rivet feed mechanisms 12 and 16. Rivet feed mechanism 12 automatically delivers rivets that have been dropped into hopper 13 to the upper pierce rivet holder 14 via slide rail 15. Rivet feed mechanism 16 delivers rivets that have been dropped into hopper 17 to the lower pierce rivet holder 18 via slide rail 19.

Figure 2:
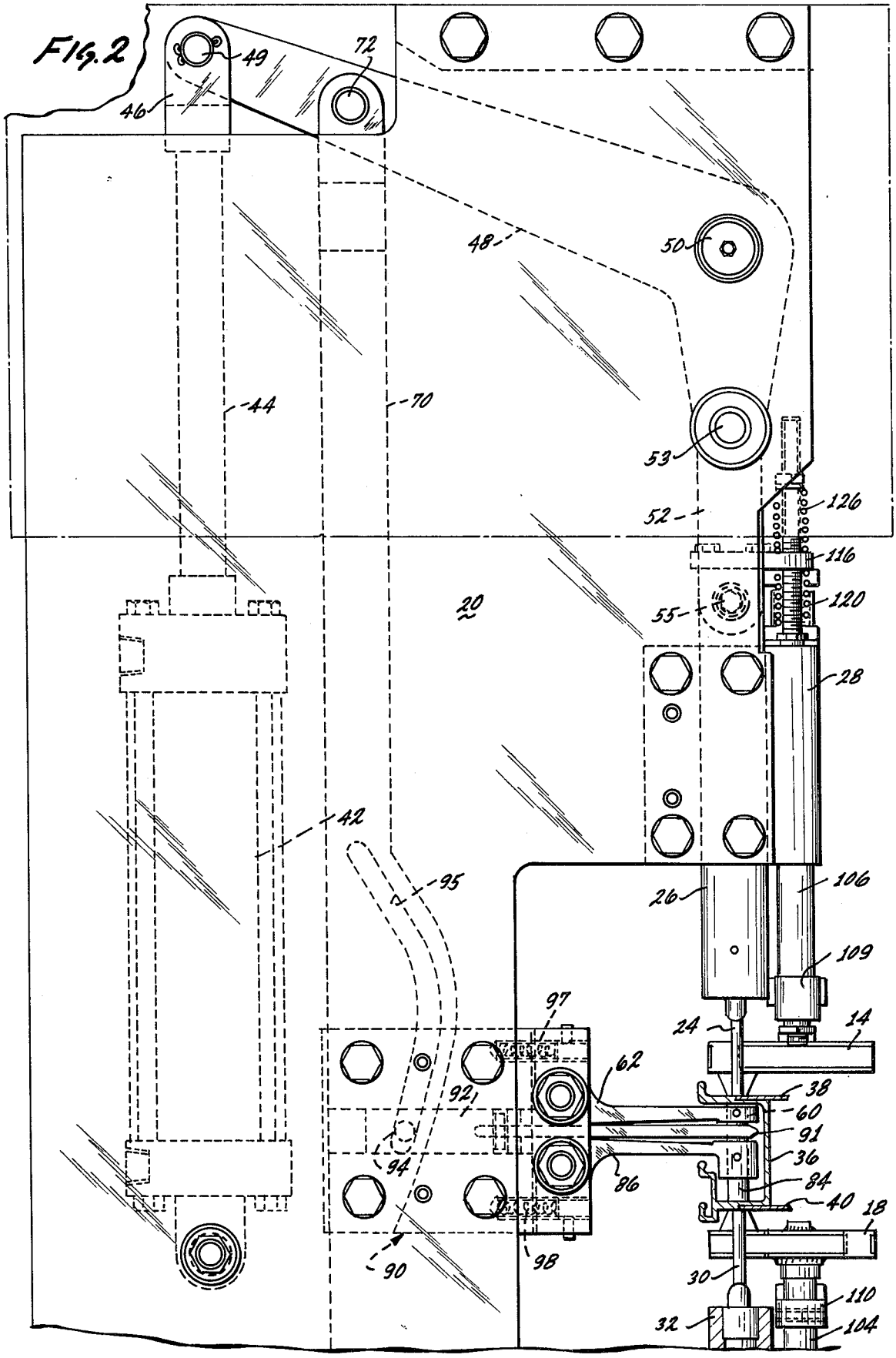
FIG. 2 is a partial side elevation view of the pierce rivet machine.
Figure 3:
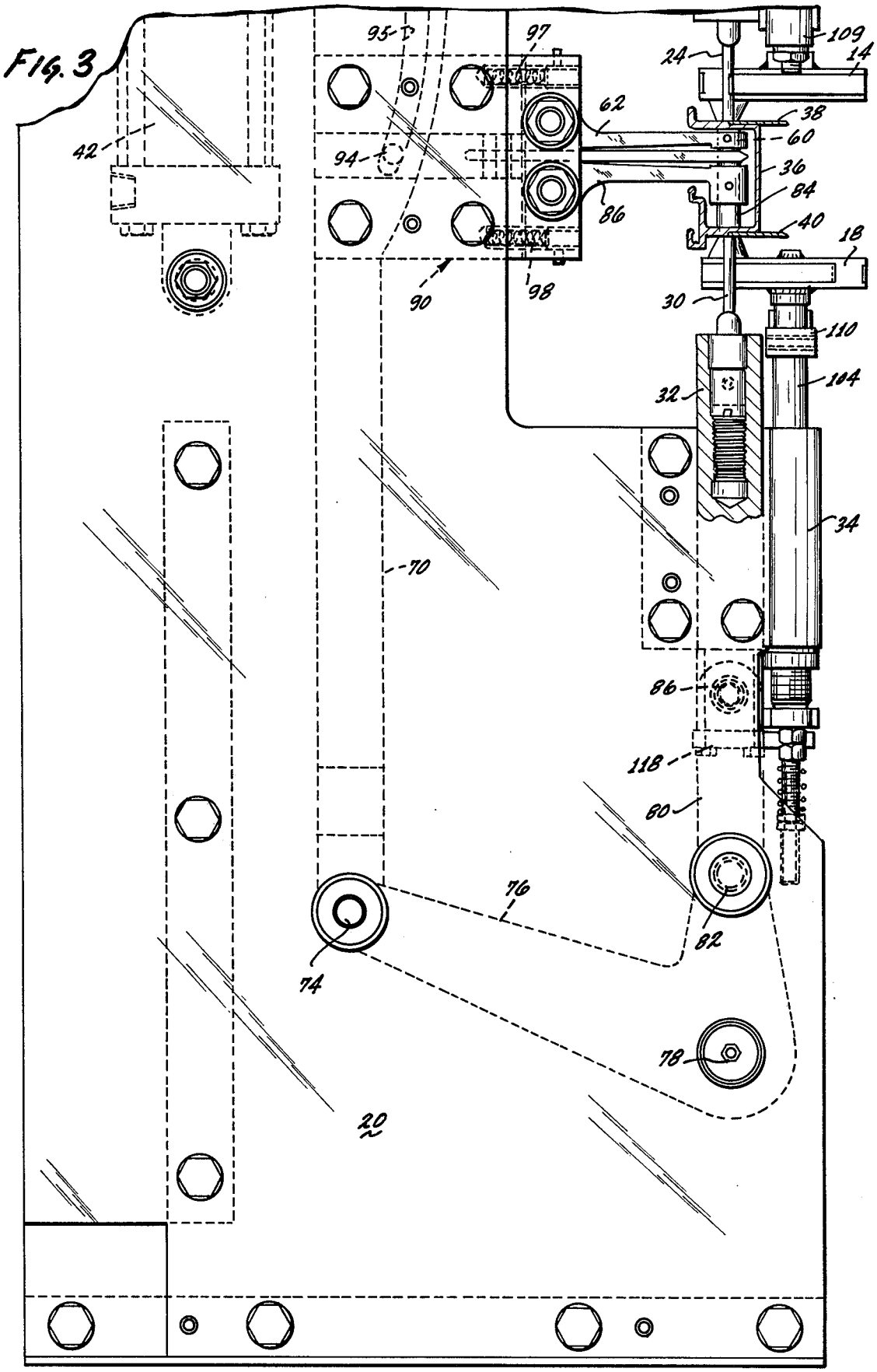
FIG. 3 is partial side elevation view of the pierce rivet machine that overlaps the lower portion of FIG. 2.
Figure 4:
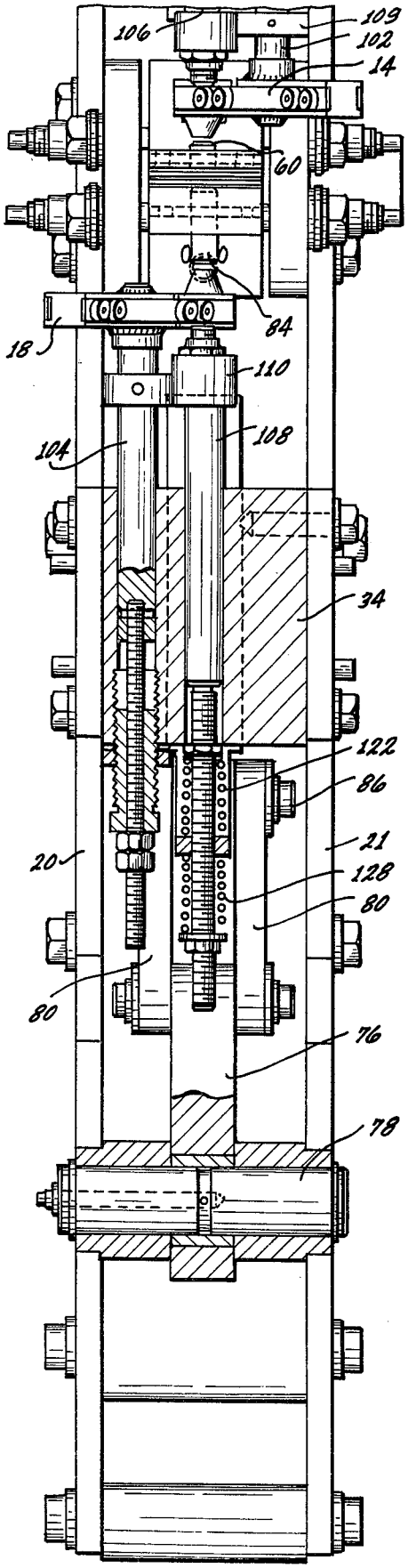
FIG. 4 is a partial front elevation view taken along the same portion of the pierce rivet machine as FIG. 3.

The structure of the machine that actively functions to perform the pierce rivet operation is best understood by referring to FIGS. 2–4. Side plates 20 and 21 provide structure for supporting the operating mechanism. The basic components of the pierce rivet machine are upper pierce rivet driver 24, upper drive rod 26, upper drive rod guide 28, lower driver 30, lower drive rod 32, and lower drive rod guide 34.

The manner in which the basic components function will now be described. Channel-shaped member 36 to which sheets of material 38 and 40 are to be riveted is inserted between upper driver 24 and lower driver 30. When the components to be riveted together are properly positioned, a button [not shown] is pushed to actuate the air motor cylinder 42. When this occurs, air is forced into the end of air cylinder 42 causing the piston within to drive piston rod 44 through its upward stroke. At the upper end of piston rod 44, rod clevis 46 is pivotally connected to upper bellcrank 48 by pivot pin 49. Upper bellcrank 48 in turn is pivotally rotated about pivot pin 50. Link member 52 has its one end pivotally attached to upper bellcrank 48 by pivot pin 53 and its lower end pivotally attached to upper drive rod 26 by pivot pin 55. As the lower end of upper bellcrank 48 is pivoted downwardly it causes link 52 to push drive rod 26 downwardly. This in turn causes drive rod 24 to contact the pierce rivet being held in upper pierce rivet holder 14 and to drive it through sheet material 38 and the upper flange of channel shaped member 36. The end of the pierce rivet is upset by upper anvil 60 mounted in upper anvil arm 62.

On the upward stroke of piston rod 44 the lower driver 30 is driven upwardly simultaneously with the downward motion of upper driver 24. The manner in which this is accomplished is as follows. A tie rod 70 has its upper end pivotally attached to upper bellcrank 48 by a pivot pin 72 and its lower end pivotally attached by a pivot pin 74 to one arm of lower bellcrank 76. The upward travel of tie bar 70 causes the lower bellcrank to rotate clockwise about pivot pin 78 causing link arm 80 that has its lower end pivotally attached to the lower bellcrank by pivot pin 82 to travel upwardly. The upper end of link member 80 is pivotally attached to lower drive rod 32. The upward travel of lower drive rod 32 causes drive rod 30 to contact the rivet being held by lower pierce rivet holder 18 and drive it through sheet material 40 and the flange of channel shaped member 36. As the rivet passes through these two members the tip of the rivet is up set by anvil 84 mounted in lower anvil arm 86.

Simultaneously with the action of driver 24 traveling downwardly and driver 66 traveling upwardly, anvil block assembly 90 is also playing an important part. This assembly allows the upper and lower anvil arms 62 and 86 to travel toward each other thus freeing the channel shaped member 36 so that it may be moved longitudinally to the next position where the rivets are to be applied. The upper and lower anvil arms 62 and 86 are spread apart by back-up plate 91. One end of the back-up plate 91 is mounted in back-up plate guide 92 that travels back and forth in the anvil block assembly 90. A pin 94 extends laterally from the back-up plate guide 92 and this pin travels in a curved longitudinal slot 95 in the tie bar 70. The curved longitudinal slot 95 acts as a cam surface and pin 94 acts as a cam follower. After the riveting function has been performed, the back-up plate is withdrawn from between upper and lower anvil arms 62 and 86 respectively. These anvil arms are spring loaded by springs 97 and 98 respectively to cause the anvil arms to rotate toward each other as back-up plate 91 is withdrawn. It is at this point that the material is transferred forwardly to the next location where the rivets are to be applied.

During the pierce riveting operation of the machine it is very important that the rivet holders 14 and 18 remain in alignment with the pierce rivet drivers 24 and 30. This is accomplished by rivet holder guides 102 and 104, and the actuator rods 106 and 108. Guide rod links 109 and 110 tie the actuator rods and the rivet holder guides together so that they move in unison. The rivet holder guides are not directly connected to a driving force and move upwardly and downwardly responsive to the movement of the actuator rods that are driven by the drive rod spring plates 116 and 118. The drive rod spring plates are fixedly secured to the ends of the drive rod so that movement of the drive rod carries the actuator rods along in a linked travel until the rivet is struck by the driver. At that point the actuator travels no further and the drive rod spring plates compress springs 120 and 122. This allows the rivet to be carried through the material with the stronger stroke of the drive rod. The rivet holder guides can be adjusted to change the length of their travel as may be necessary.

What is claimed is:

1. A pierce rivet machine for simultaneously pierce riveting sheets of material to the opposing flanges of a channel shaped member comprising:

a first pierce rivet driver and a second pierce rivet driver, said first and second pierce rivet drivers being diametrically opposed to each other, a first pierce rivet holder and a second pierce rivet holder for respectively holding rivets for said first and second pierce rivet drivers, a first and second anvil each respectively positioned to function in conjunction with the operation of said first and second pierce rivet drivers, first anvil support means and second anvil support means, a first drive rod supporting said first pierce rivet driver, a second drive rod supporting said second pierce rivet driver, means for driving said first drive rod along an axial reciprocating path and means for driving said second drive rod along an axial reciprocating path.

2. A pierce rivet machine as recited in claim 1 further comprising means for automatically feeding rivets into said first and second rivet holders.

3. A pierce rivet machine as recited in claim 1 wherein said pierce rivet holders are supported by an actuator rod that is supported in a manner to allow it travel along an axial reciprocating path during the pierce rivet operation of the machine.

4. A pierce rivet machine as recited in claim 3 further comprising a guide for each of the rivet holders and a link attached between each of said actuators and its guide to prevent the rivet holder from turning during the pierce rivet operation of the machine.

5. A pierce rivet machine as recited in claim 1 wherein said means for driving said first drive rod comprises a first bellcrank having its one end pivotally connected to a link arm which in turn is pivotally connected to said first drive rod.

6. A pierce rivet machine as recited in claim 5 wherein said means for driving said second drive rod comprises a second bellcrank having its one end pivotally connected to a link arm which in turn is pivotally connected to said second drive rod.

7. A pierce rivet machine as recited in claim 6 further comprising means for simultaneously actuating said first and second drive rods.

8. A pierce rivet machine as recited in claim 7 wherein said means for simultaneously actuating said first and second drive rods comprises a tie rod having its opposite ends pivotally connected to said first and second bellcranks.

9. A pierce rivet machine as recited in claim 8 further comprising motor means connected to one of said bellcranks.

10. A pierce rivet machine as recited in claim 9 wherein said motor means comprises an air cylinder having the free end of its piston rod pivotally connected to one of said bellcranks.

11. A pierce rivet machine as recited in claim 8 further comprising an anvil block assembly and wherein said first anvil support means comprises a first anvil arm having its one end pivotally connected to said anvil block assembly, said second anvil support means also comprises a second anvil arm having its one end pivotally connected to said anvil block assembly.

12. A pierce rivet machine as recited in claim 11 wherein said anvil block assembly comprises a back-up plate and means for driving said back-up plate into and out position between said first and second anvil support arms.

13. A pierce rivet machine as recited in claim 12 wherein said means for driving said back-up plate back and forth comprises a back-up plate guide, an elongated curved slot in said tie bar, and a pin mounted in the side of said back-up plate guide that is captured in said elongated curved slot.

* * * * *